US008506341B2

(12) United States Patent
Nakayama et al.

(10) Patent No.: US 8,506,341 B2
(45) Date of Patent: Aug. 13, 2013

(54) METHOD OF MANUFACTURING SPARKPLUGS

(75) Inventors: Katsutoshi Nakayama, Aichi (JP); Nobuaki Sakayanagi, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 97 days.

(21) Appl. No.: 13/138,720

(22) PCT Filed: Mar. 17, 2010

(86) PCT No.: PCT/JP2010/001916

§ 371 (c)(1),
(2), (4) Date: Sep. 21, 2011

(87) PCT Pub. No.: WO2010/113404

PCT Pub. Date: Oct. 7, 2010

(65) Prior Publication Data

US 2012/0015578 A1 Jan. 19, 2012

(30) Foreign Application Priority Data

Mar. 31, 2009 (JP) ..... 2009-084691

(51) Int. Cl.
*H01T 21/00* (2006.01)
*H01T 21/02* (2006.01)

(52) U.S. Cl.
USPC ..... 445/7

(58) Field of Classification Search
USPC ..... 445/7
See application file for complete search history.

(56) References Cited

U.S. PATENT DOCUMENTS

| | | | | |
|---|---|---|---|---|
| 5,578,895 | A | 11/1996 | Oshima | 313/141 |
| 6,853,116 | B2 * | 2/2005 | Hori et al. | 313/141 |
| 2002/0105254 | A1 | 8/2002 | Hori et al. | 313/141 |
| 2004/0189169 | A1 * | 9/2004 | Taniguchi et al. | 445/7 |
| 2005/0176332 | A1 | 8/2005 | Juestel et al. | 445/7 |
| 2007/0103046 | A1 | 5/2007 | Tinwell | 313/143 |
| 2008/0223831 | A1 | 9/2008 | Yoshikawa | 219/121.63 |
| 2011/0193471 | A1 * | 8/2011 | Kato | 445/7 |
| 2013/0038198 | A1 * | 2/2013 | Torii et al. | 445/7 |

FOREIGN PATENT DOCUMENTS

| | | |
|---|---|---|
| EP | 2 133 968 | 12/2009 |
| JP | 5-57466 | 3/1993 |
| JP | 7-37674 | 2/1995 |
| JP | 2002-231417 | 8/2002 |
| JP | 2002-237365 | 8/2002 |
| JP | 2004-517459 | 6/2004 |

(Continued)

OTHER PUBLICATIONS

Notification of Reasons for Refusal (dated Nov. 6, 2012) issued in connection with corresponding Japanese Patent Application No. 2010-533772, with English translation.

(Continued)

*Primary Examiner* — Mariceli Santiago
(74) *Attorney, Agent, or Firm* — Kusner & Jaffe

(57) ABSTRACT

A method of manufacturing a spark plug having an insulator, a center electrode, a metallic shell, a ground electrode, and a noble metal tip provided on the ground electrode and having a discharge surface forming a spark discharge gap in cooperation with the center electrode. The method of manufacturing includes a fusion-zone formation step of forming a fusion zone through radiation of a high-energy beam to the boundary between the ground electrode and the noble metal tip.

9 Claims, 16 Drawing Sheets

(56) References Cited

FOREIGN PATENT DOCUMENTS

| | | |
|---|---|---|
| JP | 2007-118078 | 5/2007 |
| JP | 2007-265843 | 10/2007 |
| WO | WO 2008/123343 | 10/2008 |

OTHER PUBLICATIONS

International Search Report for International Application No. PCT/JP2010/001916, Jun. 8, 2010.

* cited by examiner (A) SAMPLE 1

(B) SAMPLE 2

(C)

| | TEMPERATURE CYCLE TEST 1 (1,000°C) | TEMPERATURE CYCLE TEST 2 (1,100°C) | TEMPERATURE CYCLE TEST 3 (1,200°C) |
|---|---|---|---|
| SAMPLE 1 (ASYMMETRICAL) | ○ | △ | × |
| SAMPLE 2 (SYMMETRICAL) | ○ | ○ | ○ |

(A) JUDGED ASYMMETRICAL (B) JUDGED SUBSTANTIALLY ASYMMETRICAL

METHOD OF MANUFACTURING SPARKPLUGS

FIELD OF THE INVENTION

The present invention relates to a method of manufacturing a spark plug.

BACKGROUND OF THE INVENTION

Conventionally known methods of joining a noble metal tip to a ground electrode of a spark plug are disclosed in, for example, PCT Application Laid-Open No. 2004-517459 ("Patent Document 1") and US Patent Application Publication No. 2007/0103046 ("Patent Document 2").

According to the method disclosed in Patent Document 1, a noble metal tip is completely melted and joined to a ground electrode. This method can increase the welding strength between the ground electrode and the noble metal tip, but involves a problem of a deterioration in spark endurance, since the discharge surface of the noble metal tip contains components of a ground electrode base metal as a result of fusion.

Also, according to the method disclosed in Patent Document 2, a peripheral portion of a noble metal tip is melted, thereby joining the noble metal tip to a ground electrode. This method, however, involves the following problem: the welding strength between the ground electrode and a central portion of the noble metal tip is weak, and cracking may be generated in the noble metal tip or a fusion zone, potentially resulting in separation of the noble metal tip.

Also, a method which uses resistance welding is known for joining a noble metal tip to a ground electrode. This method, however, involves the following problem: since the layer of a fusion zone at the interface between the ground electrode and the noble metal tip is thin, welding strength fails to cope with such a severe working environment of a spark plug that is increased in temperature in association with recent tendency toward higher engine outputs, potentially resulting in separation of the noble metal tip.

SUMMARY OF THE INVENTION

The present invention has been conceived to solve the conventional problems mentioned above, and an object of the invention is to provide a technique for improving welding strength between a ground electrode and a noble metal tip.

MEANS FOR SOLVING THE PROBLEMS

To solve, at least partially, the above problems, the present invention can be embodied in the following modes or application examples.

APPLICATION EXAMPLE 1

A method of manufacturing a spark plug which comprises an insulator having an axial hole extending therethrough in an axial direction; a center electrode provided at a front end portion of the axial hole; a substantially tubular metallic shell which holds the insulator; a ground electrode whose one end portion is attached to a front end portion of the metallic shell and whose other end portion faces a front end portion of the center electrode; and a noble metal tip provided on a surface of the ground electrode which faces the front end portion of the center electrode, and having a discharge surface which forms a spark discharge gap in cooperation with the center electrode. The method comprises a fusion-zone formation step of forming a fusion zone through radiation of a high-energy beam to a boundary between the ground electrode and the noble metal tip. In the method, the fusion-zone formation step forms the fusion zone such that when the fusion zone is projected in a direction perpendicular to the discharge surface, 80% or more of an area of an overlap between the ground electrode and the noble metal tip overlaps the projected fusion zone and such that a shape of the fusion zone as viewed from a direction perpendicular to the discharge surface is substantially symmetrical with respect to a centerline perpendicular to a width direction of the ground electrode and passing through a center of the noble metal tip.

According to the method of manufacturing a spark plug of application example 1, the area of such a portion of the fusion zone that falls within the boundary between the ground electrode and the noble metal tip is increased. Therefore, the method can manufacture a spark plug having an enhanced welding strength between the ground electrode and the noble metal tip. Further, since the shape of the fusion zone is substantially symmetrical with respect to the centerline, the difference in thermal stress between the left side and the right side of the centerline can be rendered substantially zero. Therefore, deterioration in welding strength caused by the differential thermal stress can be restrained.

APPLICATION EXAMPLE 2

The method of manufacturing a spark plug described in application example 1, wherein the fusion-zone formation step includes a step of radiating the high-energy beam to the boundary while reciprocally moving the high-energy beam relative to the boundary and radiating the high-energy beam twice or more to a portion of the boundary, thereby rendering the shape of the fusion zone substantially symmetrical with respect to the centerline.

The method of manufacturing a spark plug of application example 2 can form the fusion zone whose shape is substantially symmetrical with respect to the centerline of the noble metal tip.

APPLICATION EXAMPLE 3

The method of manufacturing a spark plug described in application example 1 or 2, wherein the fusion-zone formation step includes a step of radiating the high-energy beam to the boundary while moving the high-energy beam relative to the boundary and varying output of the high-energy beam with the relative movement, thereby rendering the shape of the fusion zone substantially symmetrical with respect to the centerline.

The method of manufacturing a spark plug of application example 3 can form the fusion zone whose shape is substantially symmetrical with respect to the centerline of the noble metal tip.

APPLICATION EXAMPLE 4

The method of manufacturing a spark plug described in application example 3, wherein the fusion-zone formation step includes a step of radiating the high-energy beam to the boundary while moving the high-energy beam relative to the boundary such that the output of the high-energy beam is held constant after start of the relative movement and is then gradually reduced, thereby rendering the shape of the fusion zone substantially symmetrical with respect to the centerline.

The method of manufacturing a spark plug of application example 5 can form the fusion zone whose shape is substantially symmetrical with respect to the centerline of the noble metal tip having a shape resembling a rectangular parallelepiped.

APPLICATION EXAMPLE 5

The method of manufacturing a spark plug described in application example 3, wherein the fusion-zone formation step includes a step of radiating the high-energy beam to the boundary while moving the high-energy beam relative to the boundary such that the output of the high-energy beam is increased until the high-energy beam moves to near the centerline, and is then gradually reduced, thereby rendering the shape of the fusion zone substantially symmetrical with respect to the centerline.

The method of manufacturing a spark plug of application example 5 can form the fusion zone whose shape is substantially symmetrical with respect to the centerline of the noble metal tip having a shape resembling a circular column.

APPLICATION EXAMPLE 6

The method of manufacturing a spark plug described in any one of application examples 1 to 5, wherein the fusion-zone formation step is such that radiation of the high-energy beam is initiated before the high-energy beam is radiated to the boundary.

The method of manufacturing a spark plug of application example 6 can radiate the high-energy beam having a stable output to the boundary, so that the fusion zone can be shaped with improved accuracy.

APPLICATION EXAMPLE 7

The method of manufacturing a spark plug described in any one of application examples 1 to 6, wherein the fusion-zone formation step includes a step of radiating the high-energy beam from a direction parallel to a plane which contains the boundary.

The method of manufacturing a spark plug of application example 7 can appropriately melt the boundary between the ground electrode and the noble metal tip.

APPLICATION EXAMPLE 8

The method of manufacturing a spark plug described in any one of application examples 1 to 7, wherein the fusion-zone formation step includes a step of radiating the high-energy beam from a direction oblique to a plane which contains the boundary.

The method of manufacturing a spark plug of application example 8 can appropriately melt the boundary between the ground electrode and the noble metal tip.

APPLICATION EXAMPLE 9

The method of manufacturing a spark plug described in any one of application examples 1 to 8, wherein the high-energy beam is a fiber laser beam or an electron beam.

The method of manufacturing a spark plug of application example 9 can appropriately and deeply melt the boundary between the ground electrode and the noble metal tip.

The present invention can be implemented in various forms. For example, the present invention can be implemented in a method of manufacturing a spark plug, an apparatus for manufacturing a spark plug, and a system of manufacturing a spark plug.

DETAILED DESCRIPTION OF THE INVENTION

Embodiments of a spark plug according to a mode for carrying out the present invention will next be described in the following order.

A. First embodiment

B. Example experiment on generation of oxide scale

C. Example experiment on fusion zone overlap rate

D. Other embodiments

Figure 1:
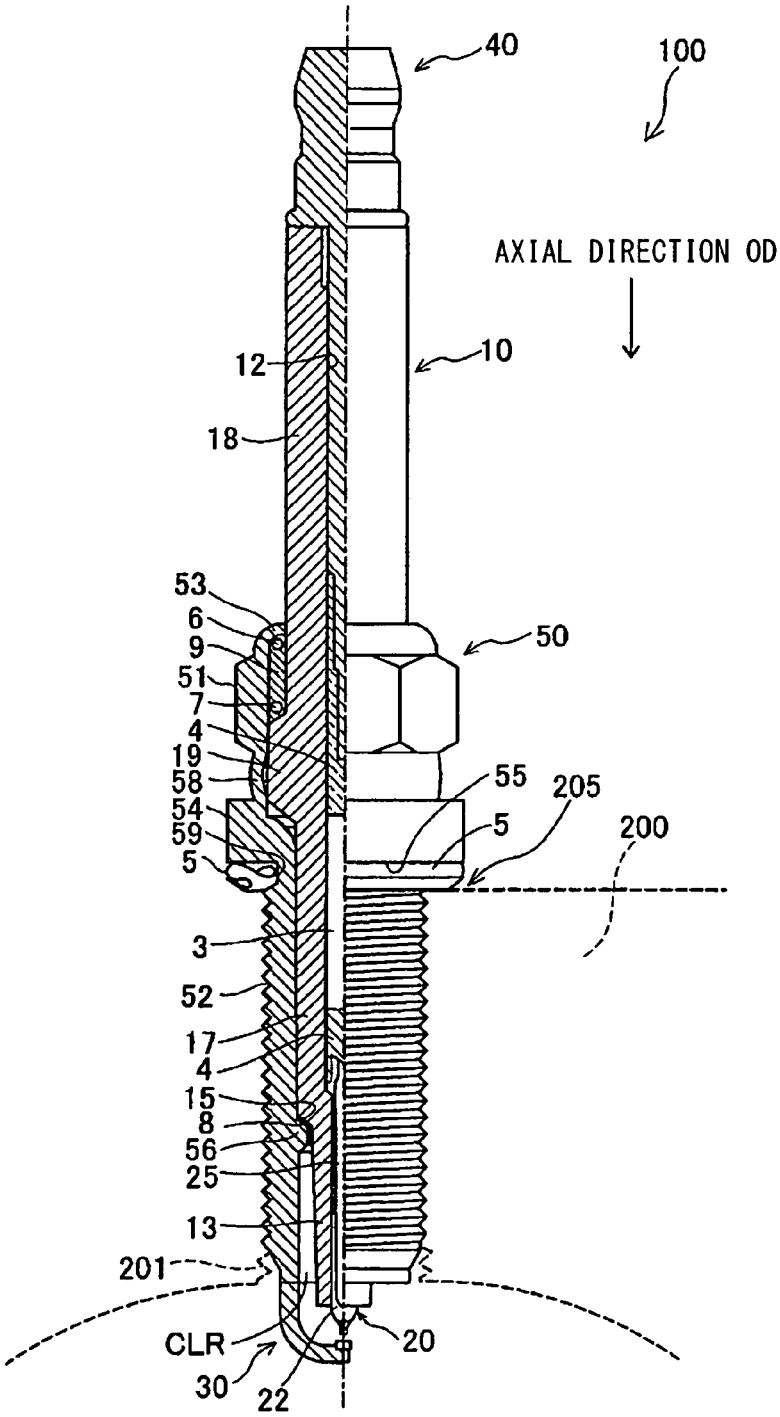
FIG. 1 is a partially sectional view showing a spark plug 100 according to a first embodiment of the present invention.

E. Criterion for judging whether or not the fusion zone is substantially symmetrical with respect to the centerline A. First Embodiment FIG. 1 is a partially sectional view showing a spark plug 100 according to an embodiment of the present invention. In the following description, an axial direction OD of the spark plug 100 in FIG. 1 is referred to as the vertical direction, and the lower side of the spark plug 100 in FIG. 1 is referred to as the front side of the spark plug 100, and the upper side as the rear side.

The spark plug 100 includes a ceramic insulator 10, a metallic shell 50, a center electrode 20, a ground electrode 30, and a metal terminal 40. The center electrode 20 is held while extending in the ceramic insulator 10 in the axial direction OD. The ceramic insulator 10 functions as an insulator. The metallic shell 50 holds the ceramic insulator 10. The metal terminal 40 is provided at a rear end portion of the ceramic insulator 10. The constitution of the center electrode 20 and the ground electrode 30 will be described in detail later with reference to FIG. 2.

The ceramic insulator 10 is formed from alumina, etc. through firing and has a tubular shape such that an axial hole 12 extends therethrough coaxially along the axial direction OD. The ceramic insulator 10 has a flange portion 19 having the largest outside diameter and located substantially at the center with respect to the axial direction OD and a rear trunk portion 18 located rearward (upward in FIG. 1) of the flange portion 19. The ceramic insulator 10 also has a front trunk portion 17 smaller in outside diameter than the rear trunk portion 18 and located frontward (downward in FIG. 1) of the flange portion 19, and a leg portion 13 smaller in outside diameter than the front trunk portion 17 and located frontward of the front trunk portion 17. The leg portion 13 is reduced in diameter in the frontward direction and is exposed to a combustion chamber of an internal combustion engine when the spark plug 100 is mounted to an engine head 200 of the engine. A stepped portion 15 is formed between the leg portion 13 and the front trunk portion 17.

The metallic shell 50 is a cylindrical metallic member formed of low-carbon steel and is adapted to fix the spark plug 100 to the engine head 200 of the internal combustion engine. The metallic shell 50 holds the ceramic insulator 10 therein while surrounding a region of the ceramic insulator 10 extending from a portion of the rear trunk portion 18 to the leg portion 13.

The metallic shell 50 has a tool engagement portion 51 and a mounting threaded portion 52. The tool engagement portion 51 allows a spark plug wrench (not shown) to be fitted thereto. The mounting threaded portion 52 of the metallic shell 50 has threads formed thereon and is threadingly engaged with a mounting threaded hole 201 of the engine head 200 provided at an upper portion of the internal combustion engine.

The metallic shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral-portion-around-opening 205 of the mounting threaded hole 201. The deformation of the gasket 5 provides a seal between the spark plug 100 and the engine head 200, thereby preventing gas leakage from inside the engine via the mounting threaded hole 201.

The metallic shell 50 has a thin-walled crimp portion 53 located rearward of the tool engagement portion 51. The metallic shell 50 also has a buckle portion 58, which is thin-walled similar to the crimp portion 53, between the seal portion 54 and the tool engagement portion 51. Annular ring members 6 and 7 intervene between an outer circumferential surface of the rear trunk portion 18 of the ceramic insulator 10 and an inner circumferential surface of the metallic shell 50 extending from the tool engagement portion 51 to the crimp portion 53. Further, a space between the two ring members 6 and 7 is filled with a powder of talc 9. When the crimp portion 53 is crimped inward, the ceramic insulator 10 is pressed frontward within the metallic shell 50 via the ring members 6 and 7 and the talc 9. Accordingly, the stepped portion 15 of the ceramic insulator 10 is supported by a stepped portion 56 formed on the inner circumference of the metallic shell 50, whereby the metallic shell 50 and the ceramic insulator 10 are united together. At this time, gastightness between the metallic shell 50 and the ceramic insulator 10 is maintained by means of an annular sheet packing 8 which intervenes between the stepped portion 15 of the ceramic insulator 10 and the stepped portion 56 of the metallic shell 50, thereby preventing outflow of combustion gas. The buckle portion 58 is designed to be deformed outwardly in association with application of compressive force in a crimping process, thereby contributing toward increasing the stroke of compression of the talc 9 and thus enhancing gastightness of the metallic shell 50. A clearance CLR having a predetermined dimension is provided between the ceramic insulator 10 and a portion of the metallic shell 50 located frontward of the stepped portion 56.

Figure 2:
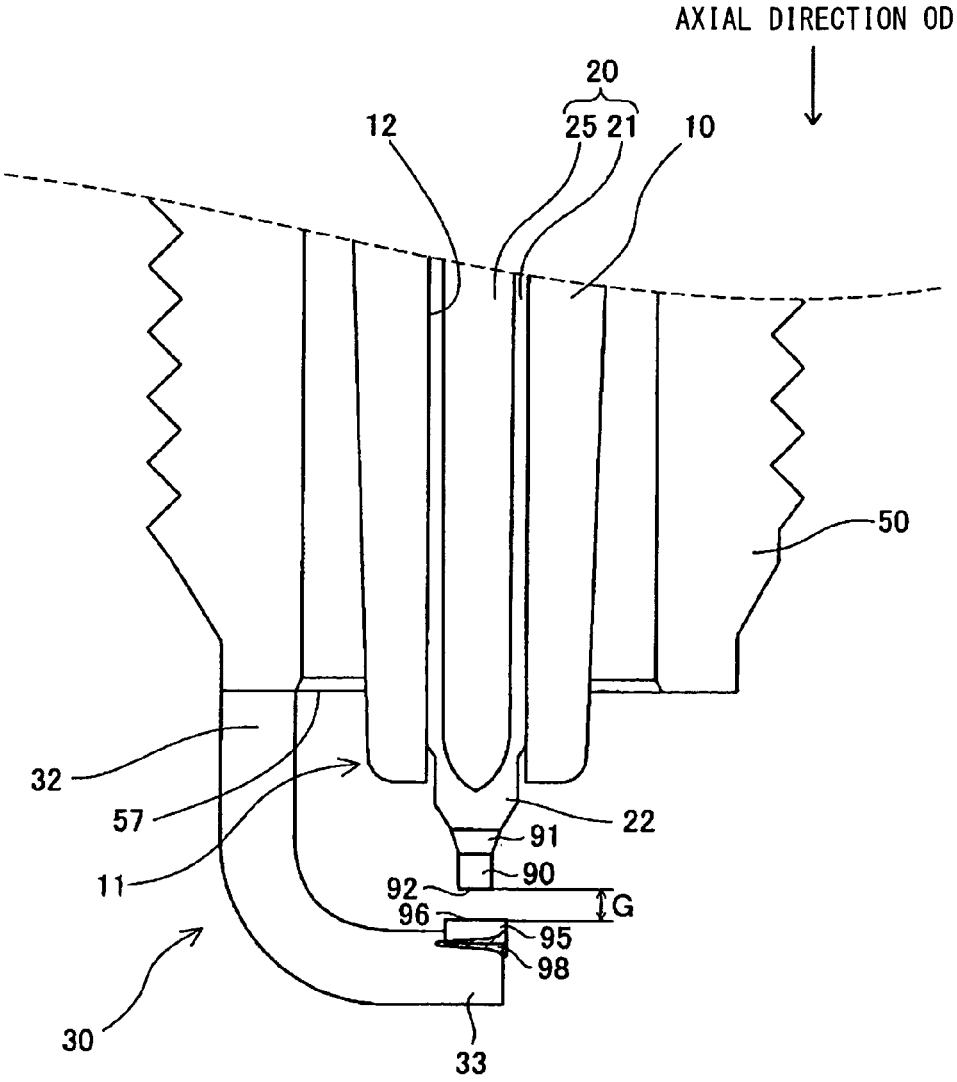
FIG. 2 is an enlarged view showing a front end portion 22 of a center electrode 20 and its periphery of the spark plug 100.

FIG. 2 is an enlarged view showing a front end portion 22 of the center electrode 20 and its periphery of the spark plug 100. The center electrode 20 is a rodlike electrode having a structure in which a core 25 is embedded within an electrode base metal 21. The electrode base metal 21 is formed of nickel or an alloy which contains Ni as a main component, such as INCONEL (trade name) 600 or 601. The core 25 is formed of copper or an alloy which contains Cu as a main component, copper and the alloy being superior in thermal conductivity to the electrode base metal 21. Usually, the center electrode 20 is fabricated as follows: the core 25 is disposed within the electrode base metal 21 which is formed into a closed-bottomed tubular shape, and the resultant assembly is drawn by extrusion from the bottom side. The core 25 is formed such that, while a trunk portion has a substantially constant outside diameter, a front end portion is tapered. The center electrode 20 extends rearward through the axial hole 12 and is electrically connected to the metal terminal 40 (FIG. 1) via a seal body 4 and a ceramic resistor 3 (FIG. 1). A high-voltage cable (not shown) is connected to the metal terminal 40 via a plug cap (not shown) for applying high voltage to the metal terminal 40.

The front end portion 22 of the center electrode 20 projects from a front end portion 11 of the ceramic insulator 10. A center electrode tip 90 is joined to the front end surface of the front end portion 22 of the center electrode 20. The center electrode tip 90 has a substantially circular columnar shape extending in the axial direction OD and is formed of a noble metal having high melting point in order to improve resistance to spark-induced erosion. The center electrode tip 90 is formed of, for example, iridium (Ir) or an Ir alloy which contains Ir as a main component and an additive of one or more elements selected from among platinum (Pt), rhodium (Rh), ruthenium (Ru), palladium (Pd), and rhenium (Re).

The ground electrode 30 is formed of a metal having high corrosion resistance. For example, an Ni alloy, such as INCONEL (trade name) 600 or 601. A proximal end portion 32 of the ground electrode 30 is joined to a front end portion 57 of the metallic shell 50 by welding. Also, the ground electrode 30 is bent such that a distal end portion 33 thereof faces a front end surface 92 of the center electrode tip 90.

Further, a ground electrode tip 95 is joined to the distal end portion 33 of the ground electrode 30 via a fusion zone 98. A discharge surface 96 of the ground electrode tip 95 faces the front end surface 92 of the center electrode tip 90. A gap G is formed between the discharge surface 96 of the ground electrode tip 95 and the front end surface 92 of the center electrode tip 90. The ground electrode tip 95 can be formed from a material similar to that used to form the center electrode tip 90.

Figure 3:
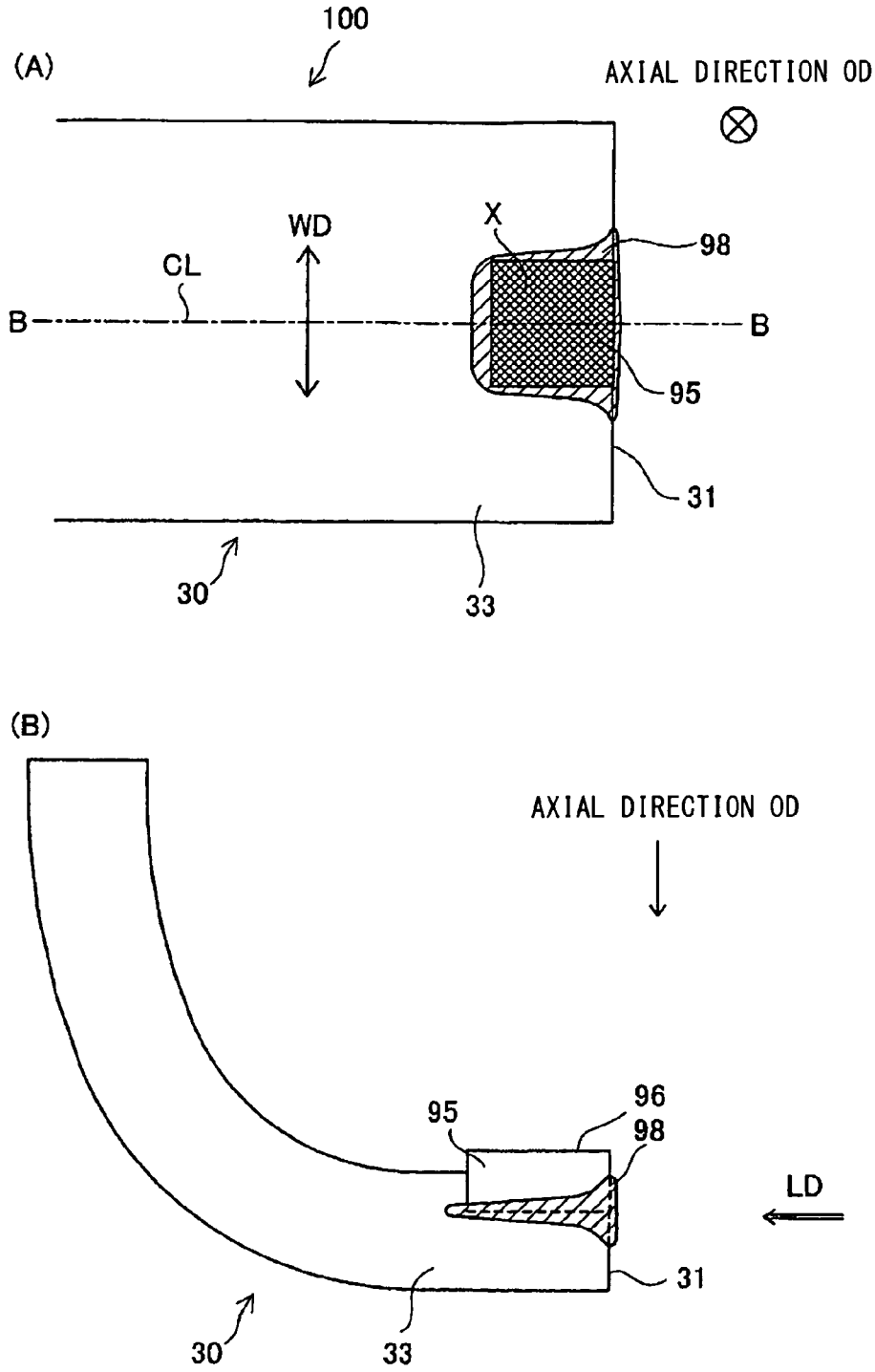
FIG. 3 is a pair of explanatory views showing, on an enlarged scale, a front end portion of the spark plug 100 according to the first embodiment of the present invention.

FIG. 3(A) is a view of the distal end portion 33 of the ground electrode 30 as viewed from the axial direction OD. FIG. 3(B) is a sectional view taken along line B-B of FIG. 3(A). As shown in FIG. 3(B), the ground electrode tip 95 is fitted in a groove formed in the ground electrode 30. The fusion zone 98 is formed at least a portion of a region between the ground electrode tip 95 and the ground electrode 30. The fusion zone 98 is formed through fusion of a portion of the ground electrode tip 95 and a portion of the ground electrode 30 and contains components of the ground electrode tip 95 and the ground electrode 30. That is, the fusion zone 98 has an intermediate composition between the ground electrode 30 and the ground electrode tip 95. In actuality, most of the fusion zone 98 is invisible from the axial direction OD; however, for convenience of description, the fusion zone 98 appears in FIG. 3(A). The same also applies to the drawings referred to in the following description. A broken line appears between the ground electrode tip 95 and the ground electrode 30. However, in actuality, in the fusion zone 98, the ground electrode tip 95 and the ground electrode 30 are fused together, and an outline represented by the broken line does not exist. The same also applies to the drawings referred to in the following description.

The fusion zone 98 can be formed through radiation of a high-energy beam from a direction LD substantially parallel to the boundary between the ground electrode 30 and the ground electrode tip 95. Preferably, a fiber laser beam or an electron beam, for example, is used as the high-energy beam for forming the fusion zone 98. The fiber laser beam and the electron beam can deeply melt the boundary between the ground electrode 30 and the ground electrode tip 95. Thus, the ground electrode 30 and the ground electrode tip 95 can be firmly joined together.

Meanwhile, as shown in FIG. 3(A), the area of an overlap (cross-hatched region X) between the ground electrode 30 and the ground electrode tip 95 is represented by S. Preferably, when the fusion zone 98 is projected in a direction perpendicular to the discharge surface 96 of the ground electrode tip 95 (i.e., in the axial direction OD), 80% or more of the area S overlaps the projected fusion zone 98. This can restrain the generation of oxide scale in the vicinity of the fusion zone 98. Grounds for this will be described later. In FIG. 3(A), 100% of the area S overlaps the fusion zone 98. Hereinafter, the percentage of such a portion of the area S that overlaps the fusion zone 98 may be referred to as the "fusion zone overlap rate LR (%)."

Further, as shown in FIG. 3(A), a line perpendicular to a width direction WD of the ground electrode 30 and passing through the center of the ground electrode tip 95 is taken as a centerline CL. In this case, preferably, the shape of the fusion zone 98 as viewed from a direction (the axial direction OD) perpendicular to the discharge surface 96 of the ground electrode tip 95 is substantially symmetrical with respect to the centerline CL. By virtue of this, the distribution of thermal stress generated in the ground electrode 30 and the ground electrode tip 95 can be rendered symmetrical with respect to the centerline CL, and the difference in thermal stress between the left side and the right side of the centerline CL can be rendered substantially zero. Therefore, deterioration in welding strength caused by the difference in thermal stress between the left and right sides can be restrained.

Figure 4:
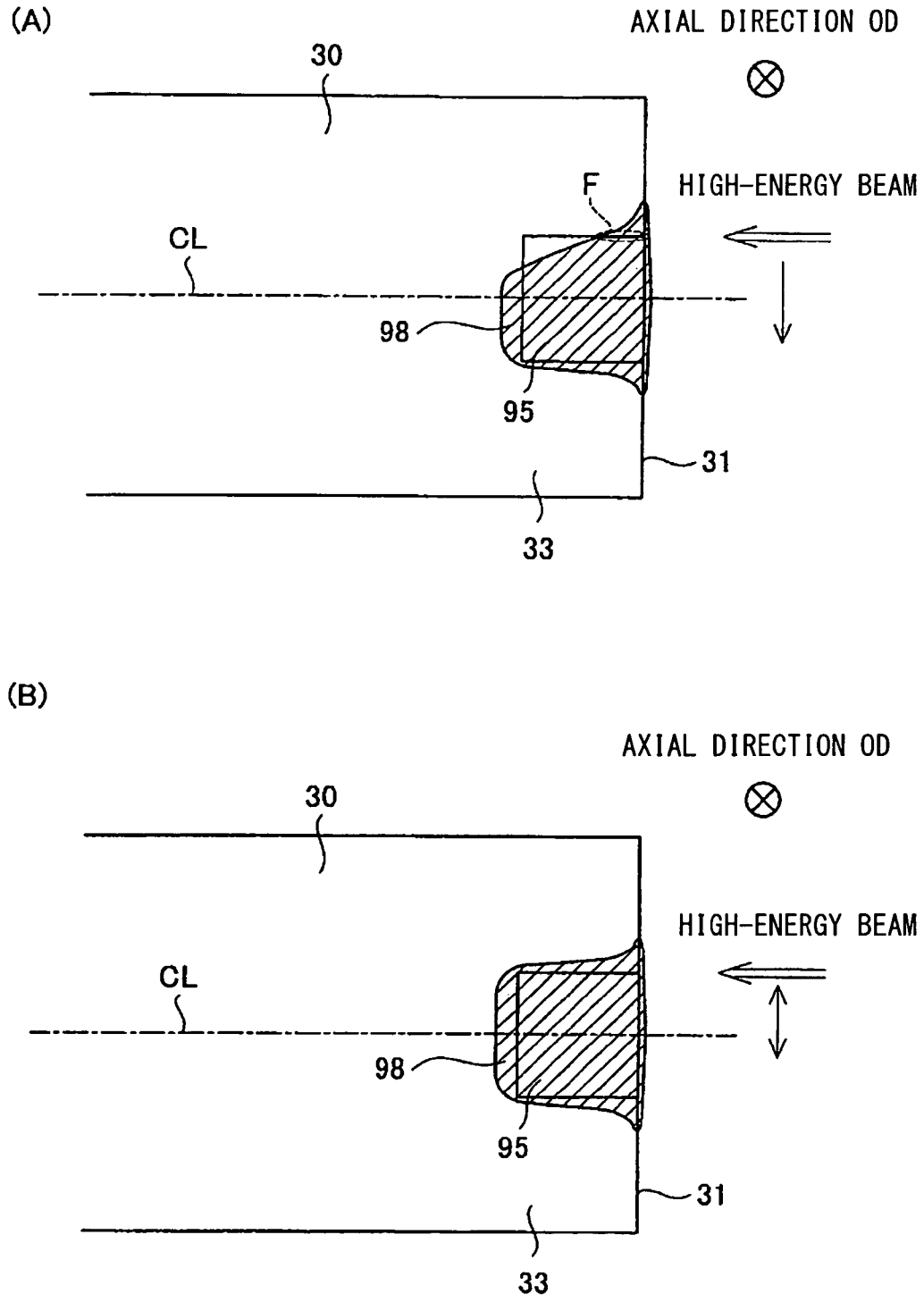
FIG. 4 is a pair of explanatory views showing an example process of formation of a fusion zone 98.

FIG. 4 is a pair of explanatory views showing an example process of formation of the fusion zone 98. In order to form the fusion zone 98 having a substantially symmetrical shape as shown in FIG. 3(A), first, the high-energy beam is radiated to the boundary between the ground electrode 30 and the ground electrode tip 95 while being moved relative to the boundary (FIG. 4(A)). By this procedure, as shown in FIG. 4(A), a portion F of the fusion zone 98 which is formed through initial radiation of the high-energy beam is short of fusion depth, and thus, the fusion zone 98 fails to have a substantially symmetrical shape as shown in FIG. 3(A). Conceivably, this is for the following reason: a portion of the fusion zone 98 which is formed through initial radiation of the high-energy beam is not sufficiently heated by the high-energy beam and thus fails to have a sufficiently high temperature for attaining a sufficient fusion depth. Thus, as shown in FIG. 4(B), the high-energy beam is reciprocally moved and radiated to a portion of the fusion zone 98 which could otherwise be short of fusion depth, so as to radiate the high-energy beam twice to the portion. By this procedure, the portion of the fusion zone 98 which could otherwise be short of fusion depth is compensated for the lack of fusion depth, so that the fusion zone 98 can have a substantially symmetrical shape. When the fusion zone 98 fails to have a substantially symmetrical shape even through two times of radiation of the high-energy beam, the high-energy beam may be radiated three times or more. In FIG. 4(A), the high-energy beam is moved. However, the boundary between the ground electrode 30 and the ground electrode tip 95 may be moved relative to the high-energy beam. The same also applies to the process shown in FIG. 5(A) and described below.

The high-energy beam may be emitted before radiation to the boundary between the ground electrode 30 and the ground electrode tip 95. By this procedure, after output of the high-energy beam is stabilized, formation of the fusion zone can be started, so that accuracy in forming the shape of the fusion zone can be improved.

Figure 5:
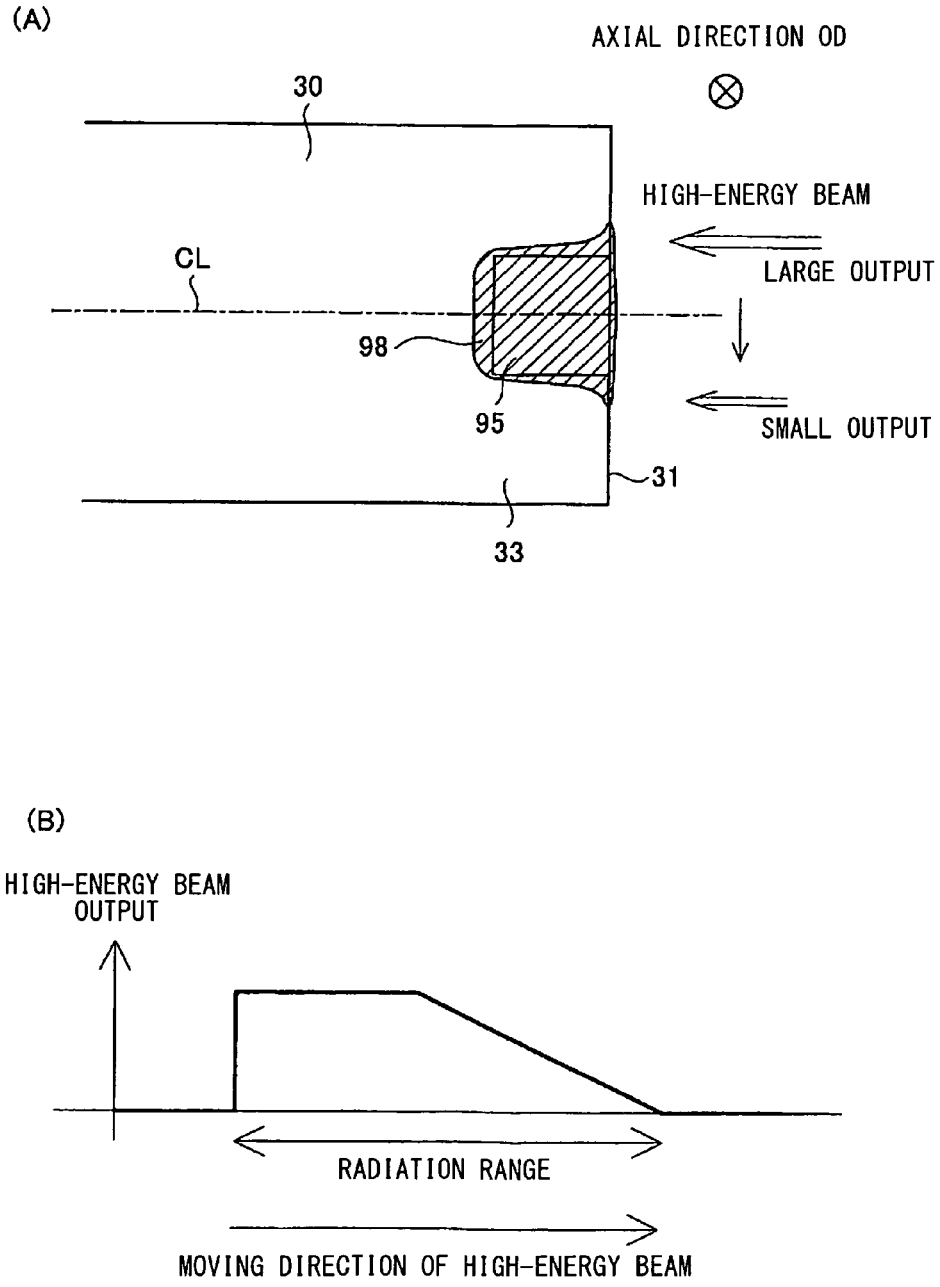
FIG. 5 is an explanatory view showing another example process of formation of the fusion zone 98, and an explanatory diagram showing an example of variation in output of a high-energy beam in the process of formation of the fusion zone 98.

FIG. 5(A) is an explanatory view showing another example process of formation of the fusion zone 98. FIG. 5(B) is an explanatory diagram showing an example of variation in output of the high-energy beam in the process of formation of the fusion zone 98. As mentioned above, since a portion of the fusion zone 98 which is formed through initial radiation of the high-energy beam is not sufficiently heated, the portion may be short of fusion depth. Therefore, in order for the fusion zone 98 to have a shape substantially symmetrical with respect to the centerline CL, output of the high-energy beam is varied with relative movement of the high-energy beam. Specifically, for example, as shown in FIG. 5(B), output of the high-energy beam is varied as follows: output of the high-energy beam is held at a high level for a while after start of radiation for sufficiently heating a radiated portion. Subsequently, output of the high-energy beam is gradually reduced. Even though output of the high-energy beam is gradually reduced, the fusion zone 98 can have a shape substantially symmetrical with respect to the centerline CL, for the following reason: heat applied by the high-energy beam is gradually conducted through the fusion zone 98 and increases the temperature of a portion which is not yet irradiated with the high-energy beam. Therefore, by means of varying output of the high-energy beam with relative movement of the high-energy beam, the fusion zone 98 can have a shape substantially symmetrical with respect to the centerline CL. The output waveform of the high-energy beam in order for the fusion zone 98 to have a shape substantially symmetrical with respect to the centerline CL is not limited to that shown in FIG. 5(B). Preferably, output of the high-energy beam is adjusted according to the material and shape of the ground electrode 30 and the ground electrode tip 95.

B. Example Experiment on Generation of Oxide Scale

In order to study the relation between the shape of a fusion zone and an oxide scale ratio, three kinds of temperature cycle tests; namely, temperature cycle tests 1, 2, and 3, were conducted. The oxide scale ratio is the ratio of the length of an oxide scale to the length of the outline of the sectional shape of the fusion zone 98 (FIG. 3(B)).

Figure 6:
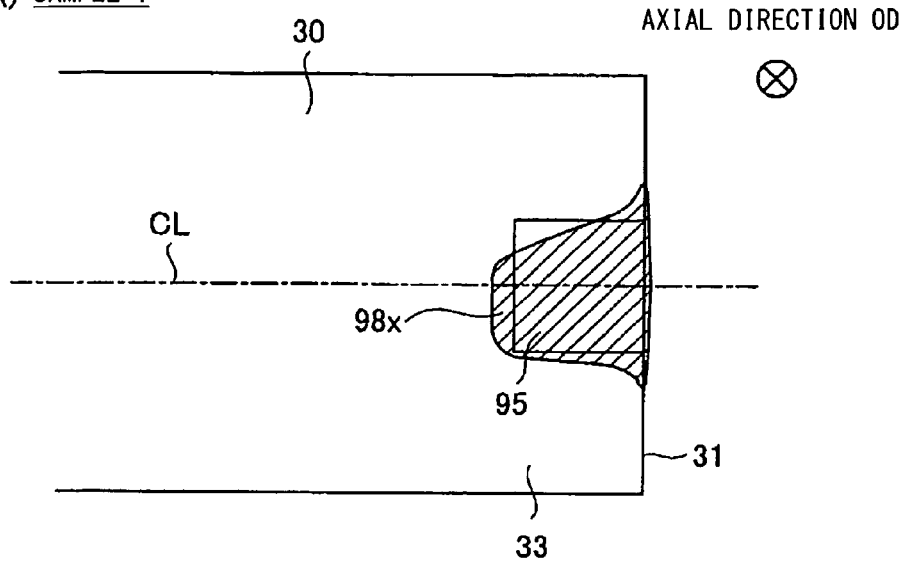
FIG. 6 is a pair of views showing front end portions of spark plugs of samples 1 and 2 used in temperature cycle tests, and a table showing the results of the temperature cycle tests.
Figure 6:
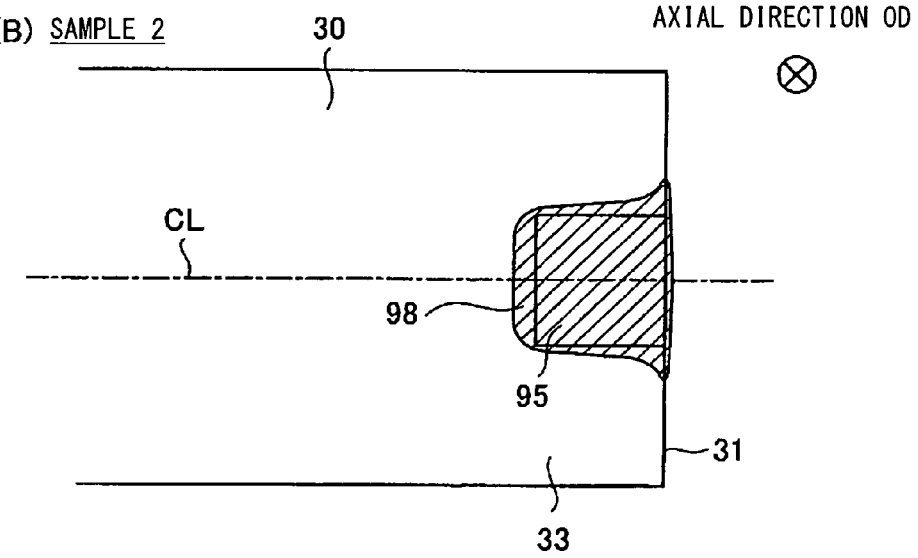

FIG. 6(A) is a view showing a front end portion of a spark plug of sample 1 used in the temperature cycle tests. FIG. 6(B) is a view showing a front end portion of a spark plug of sample 2 used in the temperature cycle tests. In the spark plug of sample 1, a fusion zone 98*x* has a shape asymmetrical with respect to the centerline CL. In the spark plug of sample 2, similar to the first embodiment shown in FIG. 3, the fusion zone 98 has a shape substantially symmetrical with respect to the centerline CL. A criterion for judging whether or not the fusion zone 98 has a shape substantially symmetrical with respect to the centerline CL will be described later.

In temperature cycle test 1, first, the ground electrode 30 was heated for two minutes with a burner so as to raise the temperature of the ground electrode 30 to 1,000° C. Subsequently, the burner was turned off, and the ground electrode 30 was allowed to gradually cool for one minute. Then, the ground electrode 30 was again heated for two minutes with the burner so as to increase the temperature of the ground electrode 30 to 1,000° C. This cycle was repeated 1,000 times. Then, the length of an oxide scale generated in the vicinity of the fusion zone was measured on an observation section. On the basis of the measured length of an oxide scale, the oxide scale ratio was obtained. Test conditions of temperature cycle test 2 are similar to those of temperature cycle test 1, except that the temperature of the ground electrode 30 is raised to 1,100° C. Similarly, test conditions of temperature cycle test 3 are similar to those of temperature cycle test 1, except that the temperature of the ground electrode 30 is raised to 1,200° C.

FIG. 6(C) is a table showing the results of the temperature cycle tests. In FIG. 6(C), when the oxide scale ratio is less than 30%, it is evaluated as "good;" when the oxide scale ratio is 30% to less than 50%, it is evaluated as "fair;" and when the oxide scale ratio is 50% or greater, it is evaluated as "failure." According to FIG. 6(C), when the fusion zone 98*x* has a shape asymmetrical with respect to the centerline CL (sample 1), evaluation in temperature cycle test 1 is "good." However, evaluation in temperature cycle test 2 is "fair," and evaluation in temperature cycle test 3 is "failure." The conceivable reason for this is described below. Since the shape of the weld zone 98*x* is asymmetrical with respect to the centerline CL, the distribution of thermal stress generated in the vicinity of the weld zone 98*x* is asymmetrical with respect to the centerline CL. As a result, the difference in thermal stress between the left side and the right side of the centerline CL is large. Thus, the joining strength between the ground electrode 30 and the ground electrode tip 95 deteriorates, so that an oxide scale is apt to be generated in the vicinity of the fusion zone 98*x*.

By contrast, when the fusion zone 98 has a shape substantially symmetrical with respect to the centerline CL (sample 2), evaluation in any one of temperature cycle tests 1 to 3 is "good." The reason for this is described below. Since the shape of the fusion zone 98 is substantially symmetrical with respect to the centerline CL, the distribution of thermal stress generated in the vicinity of the fusion zone 98 is substantially symmetrical with respect to the centerline CL. As a result, the difference in thermal stress between the left side and the right side of the centerline CL becomes substantially zero, whereby the joining strength between the ground electrode 30 and the ground electrode tip 95 can be secured sufficiently. Thus, an oxide scale is unlikely to be generated in the vicinity of the fusion zone 98. Therefore, it can be understood that the shape of the fusion zone which is substantially symmetrical with respect to the centerline CL is preferred.

C. Example Experiment on Fusion Zone Overlap Rate

In order to study the relation between the fusion zone overlap rate LR and the oxide scale ratio, a plurality of samples having different fusion zone overlap rates were subjected to the above-mentioned temperature cycle test 2.

Figure 7:
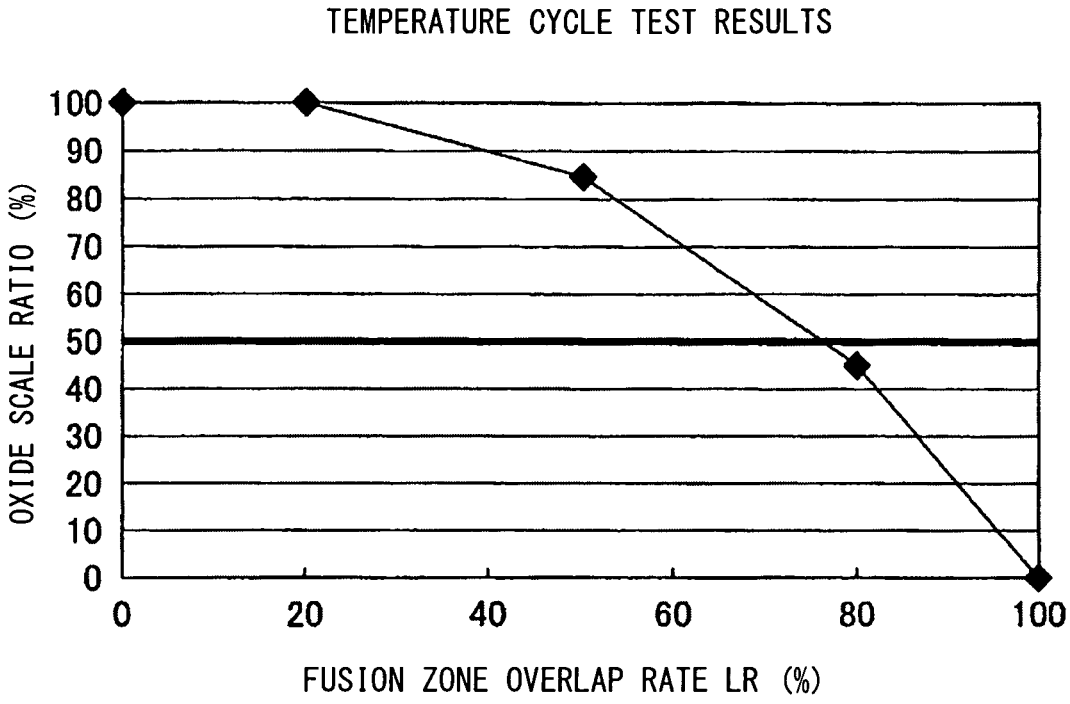
FIG. 7 is a graph showing the results of a temperature cycle test.

FIG. 7 is a graph showing the results of the temperature cycle test. It can be understood from FIG. 7 that as the fusion zone overlap rate LR increases, the oxide scale ratio decreases. Further, it can be understood that when the fusion overlap rate LR is 80% or greater, the oxide scale ratio becomes less than 50%. The conceivable reason for this is as follows: the higher the fusion zone overlap rate LR, the greater the enhancement of joining strength between the ground electrode 30 and the ground electrode tip 95, and the less likely generation of an oxide scale in the vicinity of the fusion zone 98. Therefore, as in the case of the above-mentioned embodiment, preferably, the fusion zone overlap rate LR is 80% or greater.

D. Other Embodiments

Figure 8:
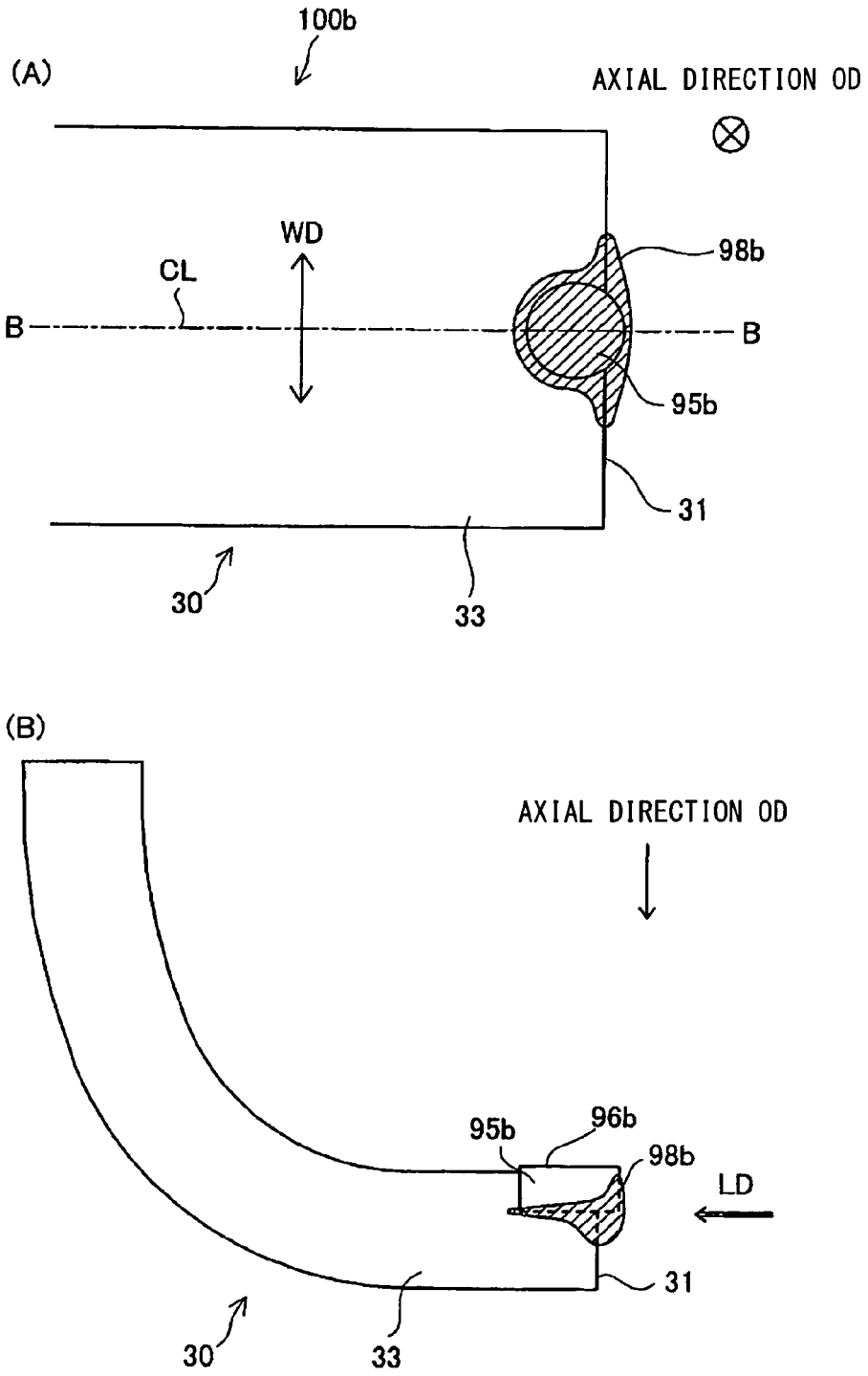
FIG. 8 is a pair of explanatory views showing, on an enlarged scale, a front end portion of a spark plug 100*b* according to another embodiment of the present invention.

FIG. 8 is a pair of explanatory views showing, on an enlarged scale, a front end portion of a spark plug 100*b* according to another embodiment of the present invention. FIG. 8(A) is a view of the ground electrode 30 as viewed from the axial direction OD. FIG. 8(B) is a sectional view taken along line B-B of FIG. 8(A). The present embodiment differs from the first embodiment (FIG. 3) in that a ground electrode tip 95*b* has a shape resembling a circular column and that the ground electrode tip 95*b* projects from a distal end surface 31 of the ground electrode 30. Other configurational features of the present embodiment are similar to those of the first embodiment. In this manner, the ground electrode tip can have any shape.

Figure 9:
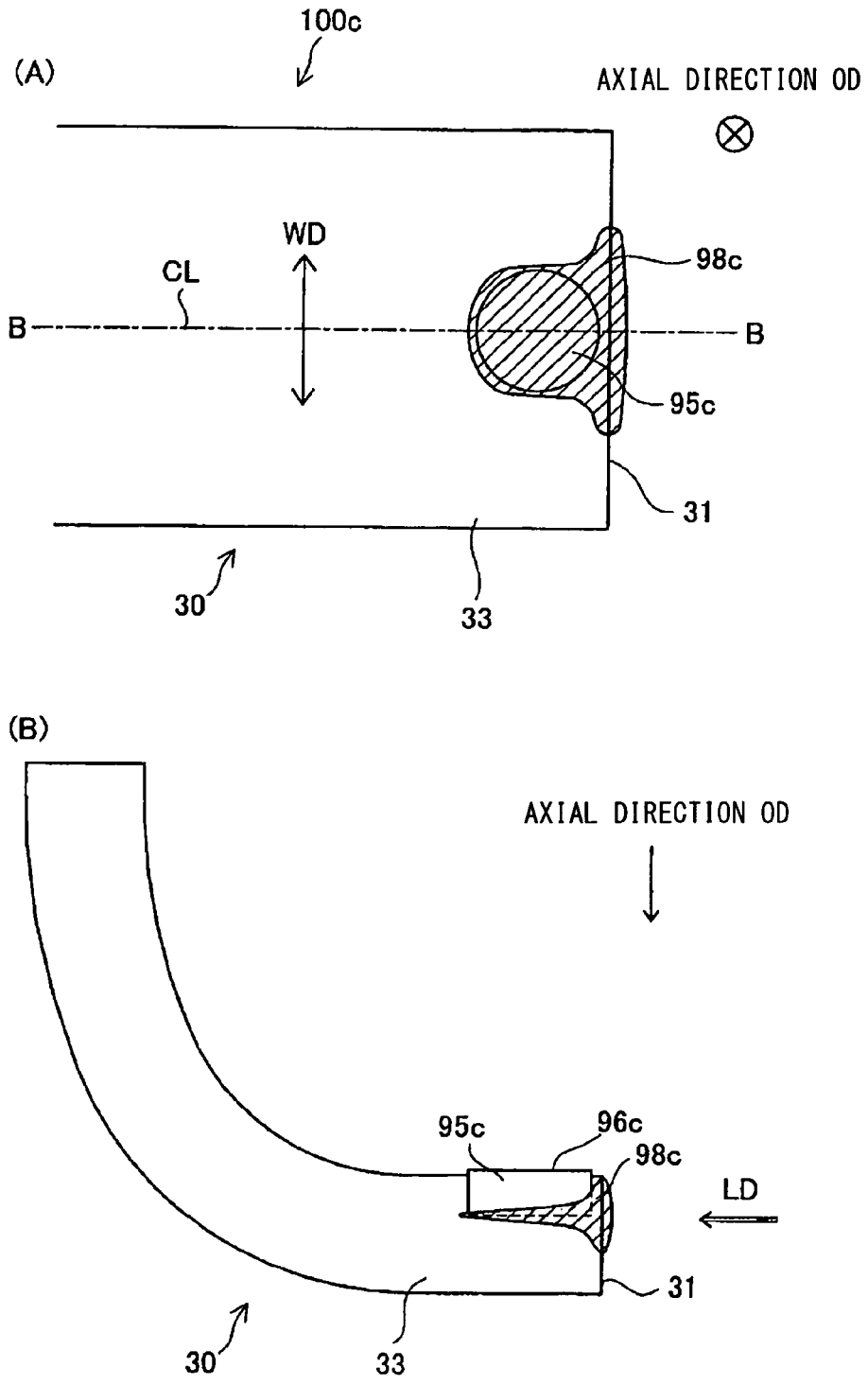
FIG. 9 is a pair of explanatory views showing, on an enlarged scale, a front end portion of a spark plug 100*c* according to a further embodiment of the present invention.

FIG. 9 is a pair of explanatory views showing, on an enlarged scale, a front end portion of a spark plug 100*c* according to a further embodiment of the present invention. FIG. 9(A) is a view of the ground electrode 30 as viewed from the axial direction OD. FIG. 9(B) is a sectional view taken along line B-B of FIG. 9(A). The present embodiment differs from the first embodiment (FIG. 3) in that a ground electrode tip 95*c* has a shape resembling a circular column. Other configurational features of the present embodiment are similar to those of the first embodiment. In this manner, the ground electrode tip can have any shape.

Figure 10:
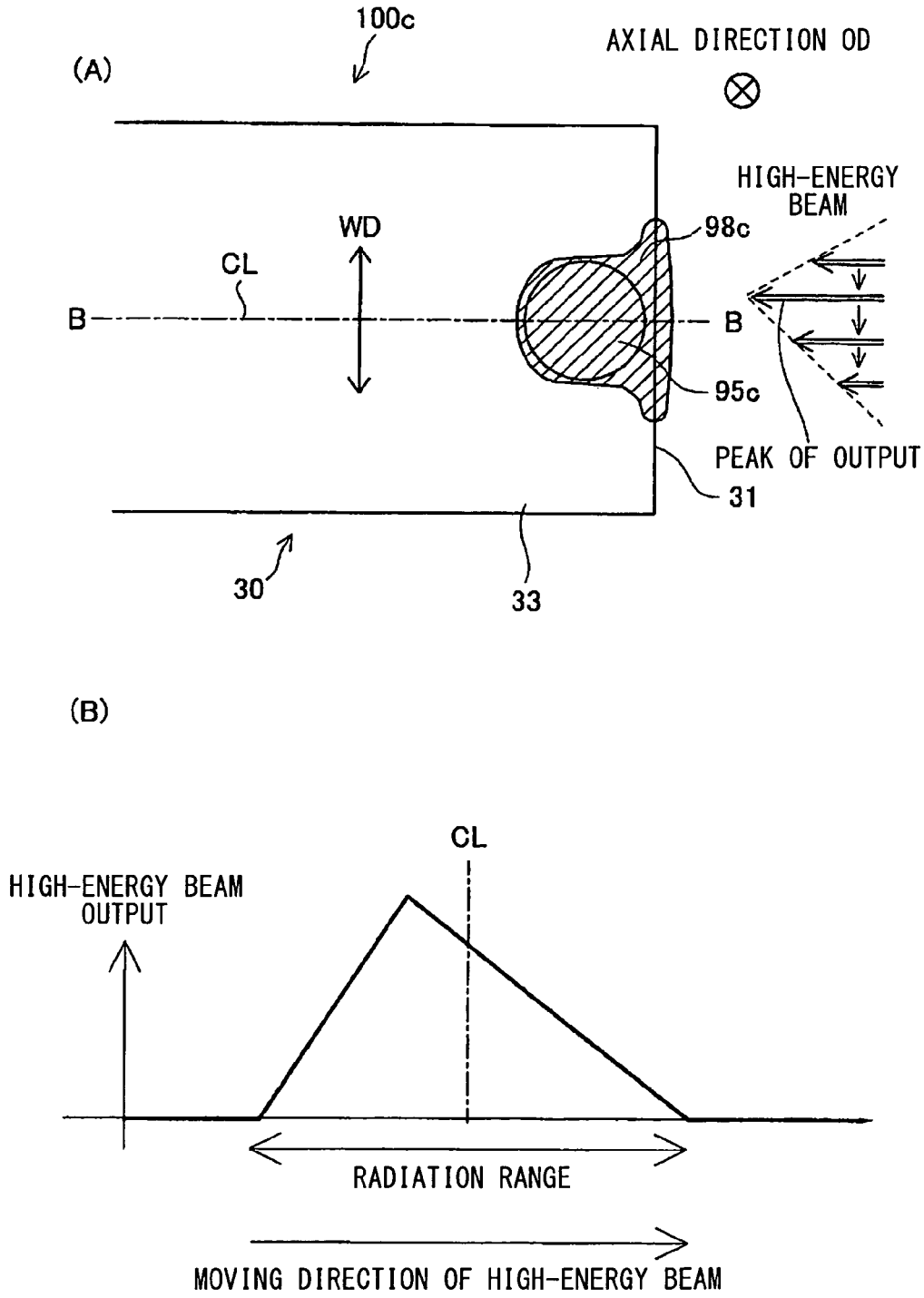
FIG. 10 is an explanatory view showing an example process of formation of a fusion zone 98*c*, and an explanatory diagram showing an example of variation in output of the high-energy beam in the process of formation of the fusion zone 98*c*.

FIG. 10(A) is an explanatory view showing an example process of formation of a fusion zone 98*c* of the spark plug 100*c* shown in FIG. 9. FIG. 10(B) is an explanatory diagram showing an example of variation in output of the high-energy beam in the process of formation of the fusion zone 98*c*. In this spark plug 100*c*, the ground electrode tip 95*c* has a substantially circular columnar shape. Thus, in order for the fusion zone 98*c* to have a shape which is substantially symmetrical with respect to the centerline CL and follows an outline arc of the ground electrode tip 95*c*, preferably, output of the high-energy beam is varied with the relative movement of the high-energy beam. Specifically, for example, as shown by the arrows in FIG. 10(A) and shown in FIG. 10(B), output of the high-energy beam is increased until the high-energy beam moves to near the centerline CL, and is then gradually reduced. That is, output of the high-energy beam is increased with the relative movement of the high-energy beam so as to reach a peak value when the high-energy beam moves to near the centerline CL, and is then reduced more gently than in the increasing stage. Even though output of the high-energy beam peaks when the high-energy beam moves to near the centerline CL, the fusion zone 98*c* can have a shape substantially symmetrical with respect to the centerline CL, for the following reason: heat applied by the high-energy beam is gradually conducted through the fusion zone 98*c* and increases the temperature of a portion which is not yet irradiated with the high-energy beam. Therefore, by means of varying output of the high-energy beam with the relative movement of the high-energy beam as represented by the waveform shown in FIG. 10(B), the fusion zone 98*c* can have a shape which is substantially symmetrical with respect to the centerline CL and follows an outline arc of the ground electrode tip 95*c*.

Figure 11:
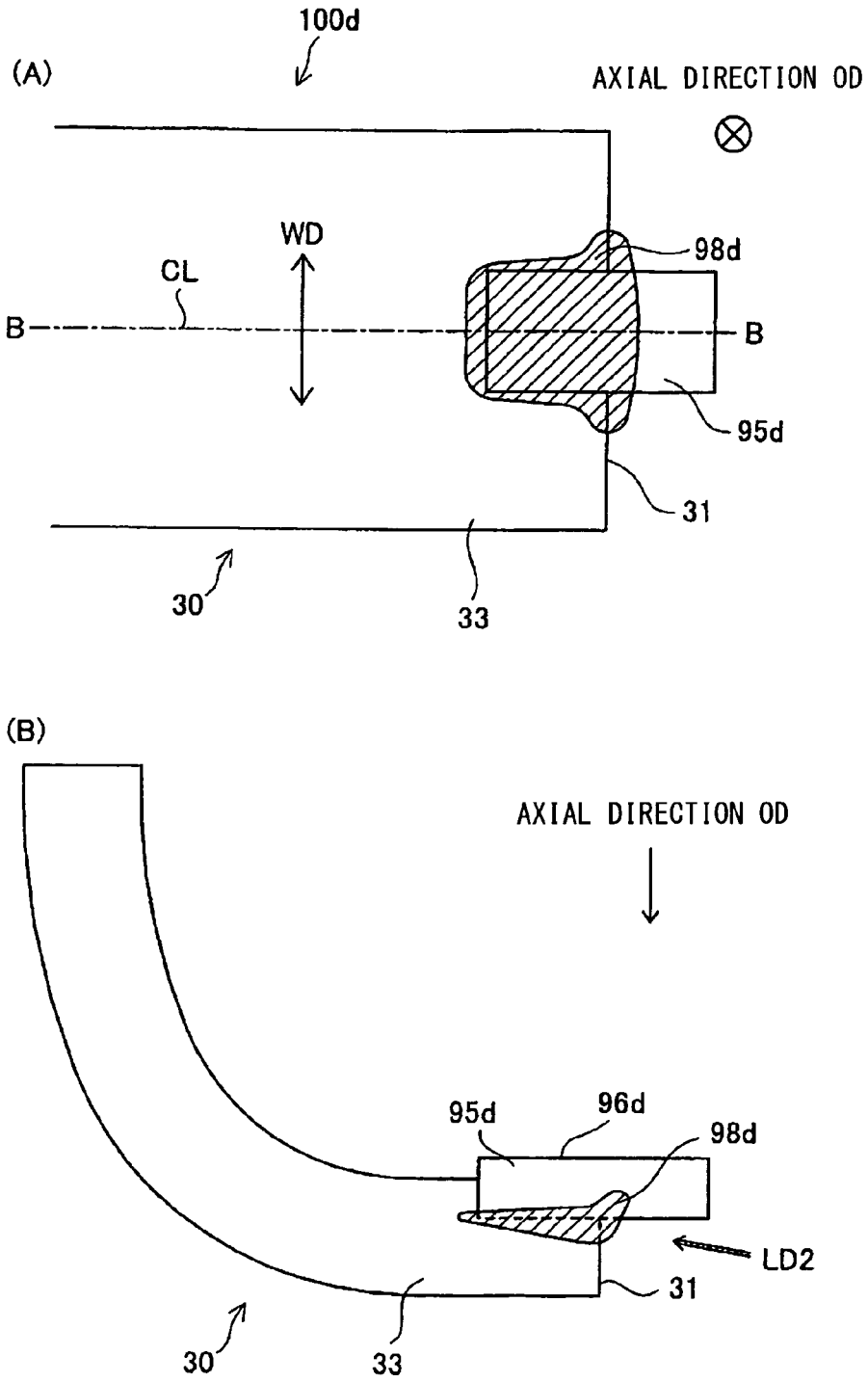
FIG. 11 is a pair of explanatory views showing, on an enlarged scale, a front end portion of a spark plug 100*d* according to a still further embodiment of the present invention.

FIG. 11 is a pair of explanatory views showing, on an enlarged scale, a front end portion of a spark plug 100*d* according to a still further embodiment of the present invention. FIG. 11(A) is a view of the ground electrode 30 as viewed from the axial direction OD. FIG. 11(B) is a sectional view taken along line B-B of FIG. 11(A). The present embodiment differs from the first embodiment (FIG. 3) in that a ground electrode tip 95*d* projects in a greater amount from the distal end surface 31 of the ground electrode 30 and that, when the fusion zone 98*d* is formed, the high-energy beam is radiated from a direction LD2 oblique to the boundary between the ground electrode 30 and the ground electrode tip 95*d*. Other configurational features of the present embodiment are similar to those of the first embodiment. In this manner, the ground electrode tip can have any shape. Also, the high-energy beam may be radiated from a direction oblique to the boundary between the ground electrode 30 and the ground electrode tip 95*d*.

Figure 12:
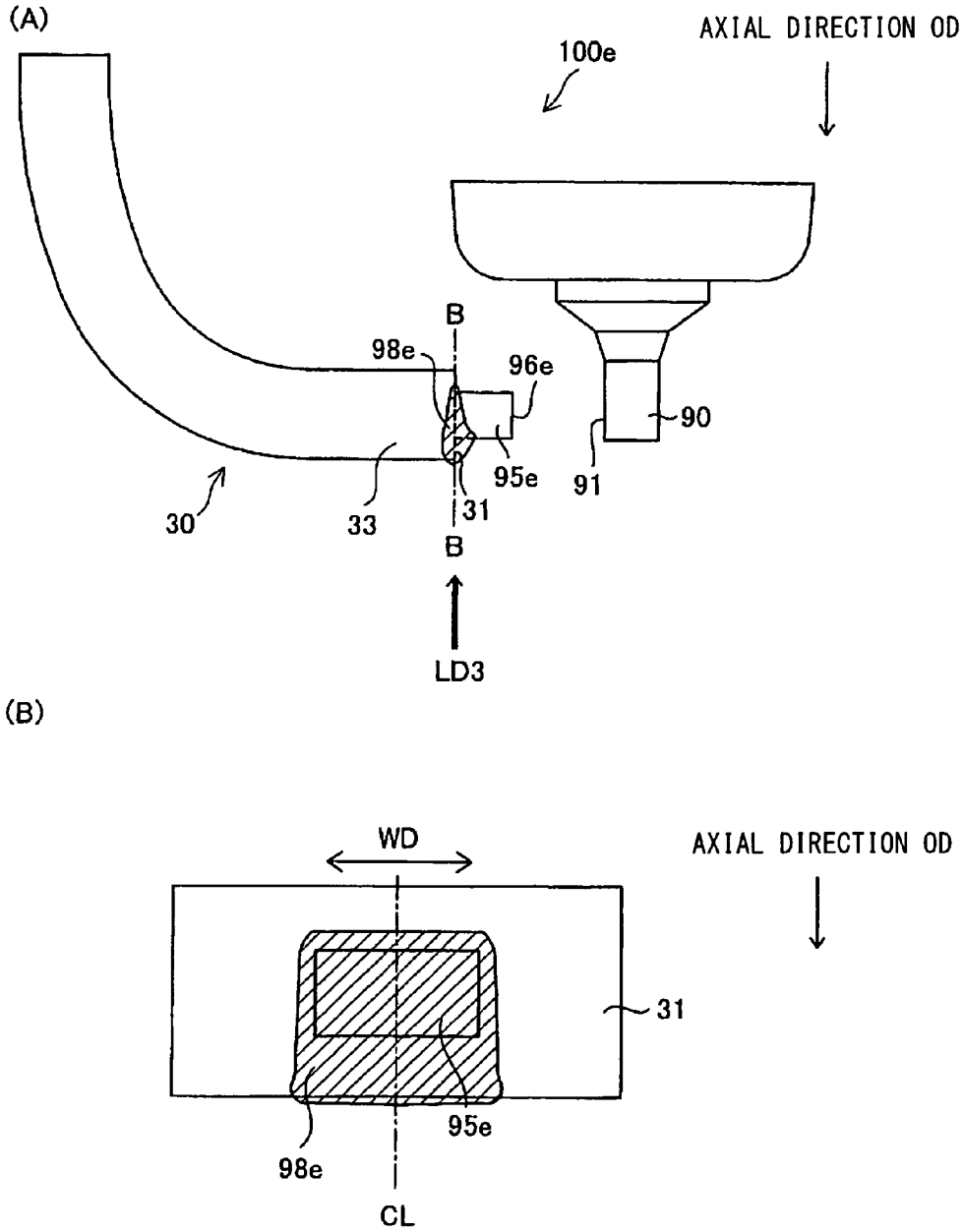
FIG. 12 is a pair of explanatory views showing, on an enlarged scale, a front end portion of a spark plug 100*e* according to yet another embodiment of the present invention.

FIG. 12 is a pair of explanatory views showing, on an enlarged scale, a front end portion of a spark plug 100*e* according to yet another embodiment of the present invention. FIG. 12(A) is a view of the ground electrode 30 as viewed from a direction perpendicular to the axial direction OD. FIG. 12(B) is a sectional view taken along line B-B of FIG. 12(A). The present embodiment differs from the first embodiment (FIG. 3) in that a ground electrode tip 95*e* is joined to the distal end surface 31 of the ground electrode 30 and that a discharge surface 96*e* of the ground electrode tip 95*e* faces a side surface 91 of the center electrode tip 90. That is, the spark plug 100*e* is of a so-called lateral discharge type.

In the present embodiment, the high-energy beam is radiated from a direction LD3 parallel to the boundary between the ground electrode tip 95*e* and the ground electrode 30, thereby forming a fusion zone 98*e*. The fusion zone 98*e* has a shape substantially symmetrical with respect to the centerline CL which is perpendicular to the width direction WD of the ground electrode 30 and passes through the center of the ground electrode tip 95*e*. Through employment of such a configuration, even in a lateral-discharge-type spark plug, the difference in thermal stress between the left side and the right side of the centerline CL can be rendered substantially zero. Therefore, deterioration in joining strength between the ground electrode 30 and the ground electrode tip 95*e* can be restrained.

Figure 13:
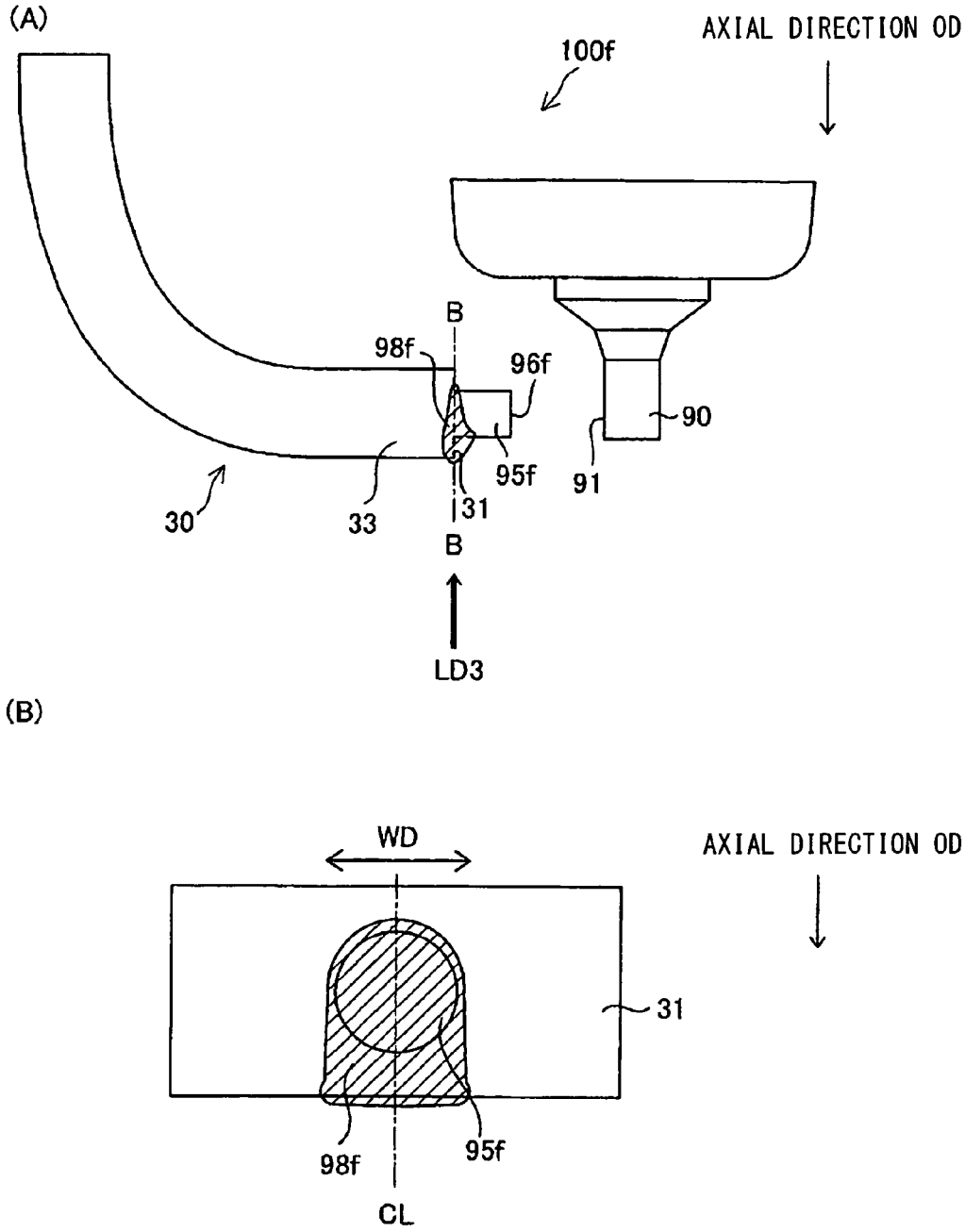
FIG. 13 is a pair of explanatory views showing, on an enlarged scale, a front end portion of a spark plug 100*f* according to another embodiment of the present invention.

FIG. 13 is a pair of explanatory views showing, on an enlarged scale, a front end portion of a spark plug 100*f* according to another embodiment of the present invention. FIG. 13(A) is a view of the ground electrode 30 as viewed from a direction perpendicular to the axial direction OD. FIG. 13(B) is a sectional view taken along line B-B of FIG. 13(A). The present embodiment differs from the embodiment shown in FIG. 12 in that a ground electrode tip 95*f* has a shape resembling a circular column. Other configurational features of the present embodiment are similar to those of the embodiment shown in FIG. 12. In this manner, the ground electrode tip can have any shape.

Figure 14:
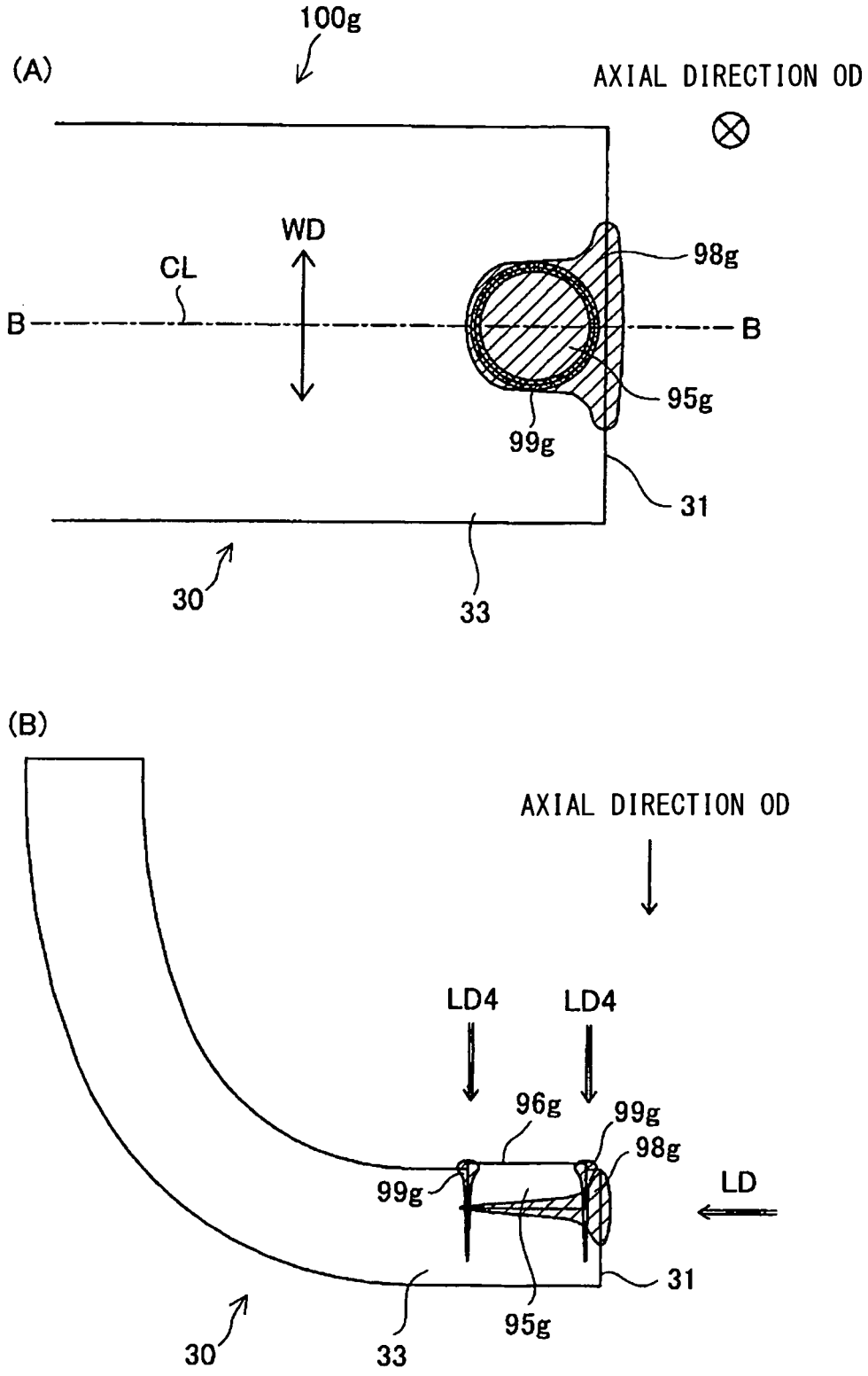
FIG. 14 is a pair of explanatory views showing, on an enlarged scale, a front end portion of a spark plug 100*g* according to a further embodiment of the present invention.

FIG. 14 is a pair of explanatory views showing, on an enlarged scale, a front end portion of a spark plug 100*g* according to a further embodiment of the present invention. FIG. 14(A) is a view of the ground electrode 30 as viewed from the axial direction OD. FIG. 14(B) is a sectional view taken along line B-B of FIG. 14(A). The present embodiment differs from the embodiment shown in FIG. 9 in that the high-energy beam is radiated also from a direction LD4 along the axial direction OD, thereby forming a fusion zone 99*g*. Other configurational features of the present embodiment are similar to those of the embodiment shown in FIG. 9. In this manner, through formation of the fusion zone 99*g* in addition to a fusion zone 98*g*, the joining strength between the ground electrode 30 and the ground electrode tip 95 can be further enhanced.

Figure 15:
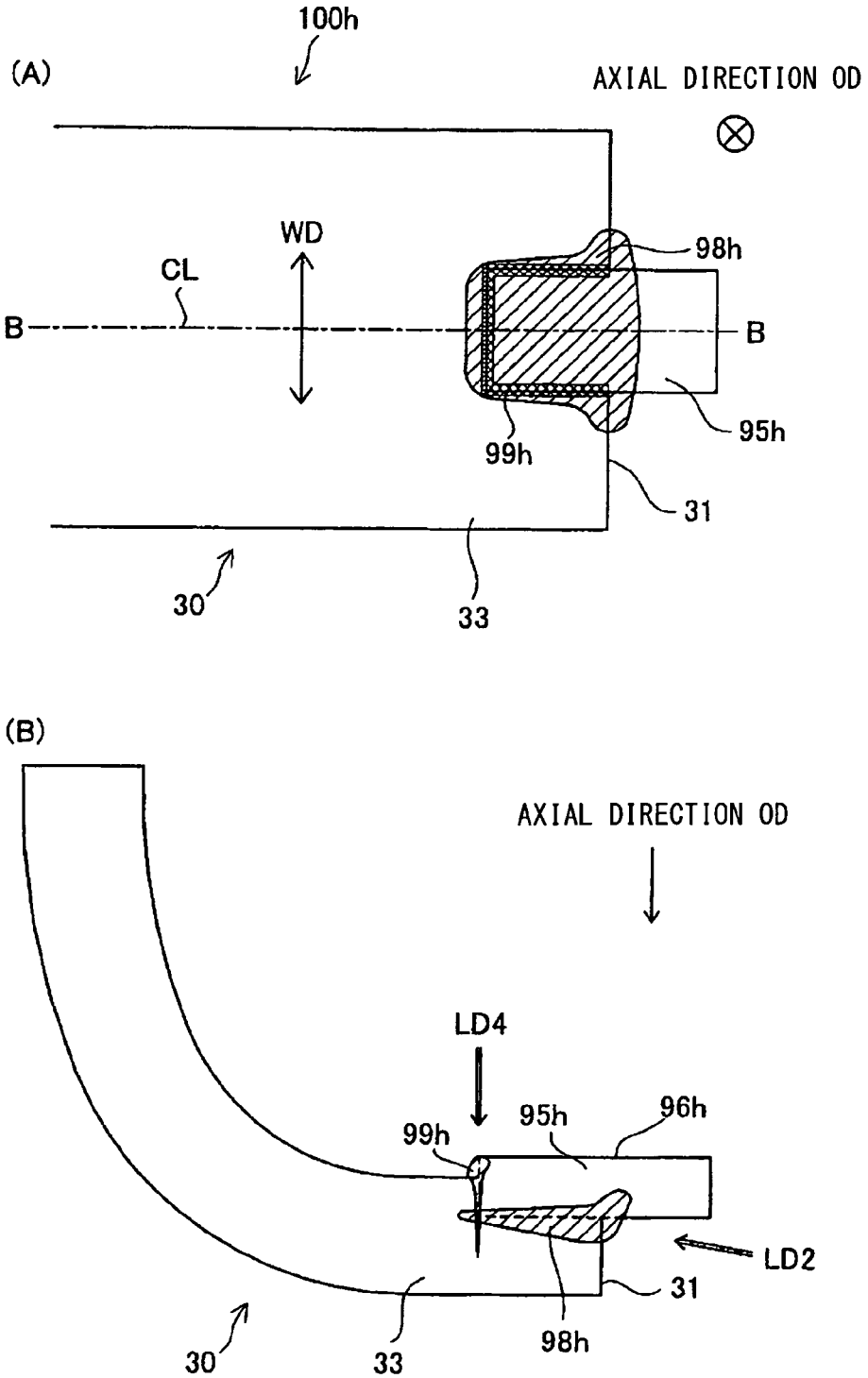
FIG. 15 is a pair of explanatory views showing, on an enlarged scale, a front end portion of a spark plug 100*h* according to a still further embodiment of the present invention.

FIG. 15 is a pair of explanatory views showing, on an enlarged scale, a front end portion of a spark plug 100*h* according to a still further embodiment of the present invention. FIG. 15(A) is a view of the ground electrode 30 as viewed from the axial direction OD. FIG. 15(B) is a sectional view taken along line B-B of FIG. 15(A). The present embodiment differs from the embodiment shown in FIG. 11 in that the high-energy beam is radiated also from the direction LD4 along the axial direction OD, thereby forming a fusion zone 99*h*. Other configurational features of the present embodiment are similar to those of the embodiment shown in FIG. 11. In this manner, through formation of the fusion zone 99*h* in addition to a fusion zone 98*h*, the joining strength between the ground electrode 30 and the ground electrode tip 95 can be further enhanced.

Figure 16:
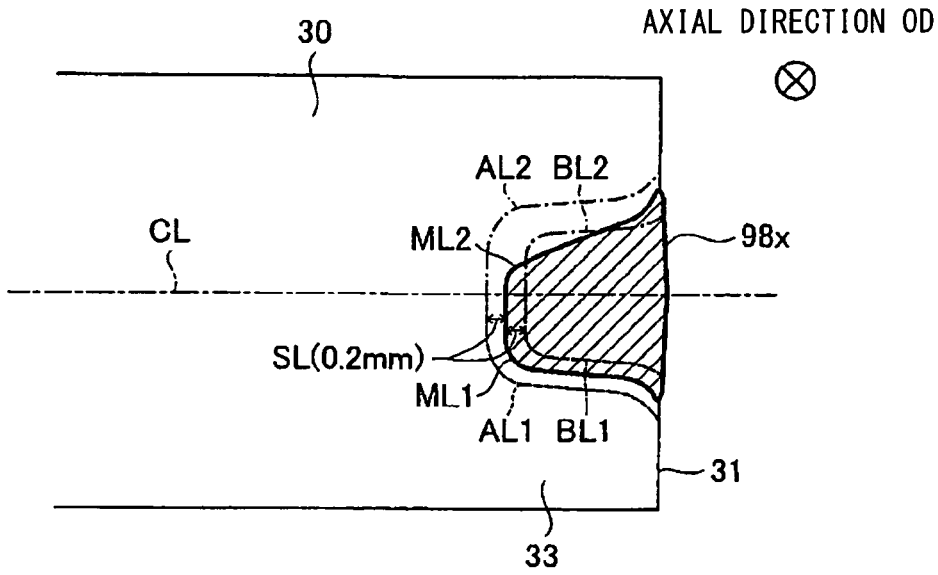
FIG. 16 is a pair of explanatory views showing a criterion for judging whether or not the fusion zone 98 is substantially symmetrical with respect to a centerline CL.
Figure 16:
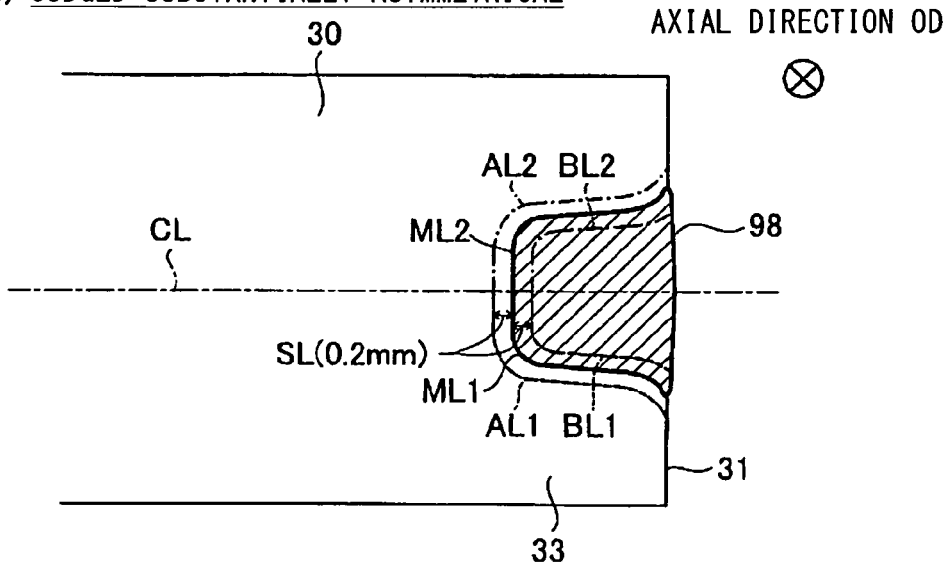

E. Criterion for Judging Whether or Not the Fusion Zone is Substantially Symmetrical with Respect to the Centerline FIG. 16 is a pair of explanatory views showing a criterion for judging whether or not the fusion zone is substantially symmetrical with respect to the centerline CL. FIG. 16 shows a state in which the fusion zone is cut by a plane perpendicular to the axial direction OD. In the present specification, whether or not the fusion zone is substantially symmetrical with respect to the centerline CL is judged by focusing on the outline of the section of the fusion zone.

Specifically, in FIG. 16(A), an outline ML1 represents a portion of the outline of the fusion zone 98*x* which is located on the lower side of the centerline CL, and an outline ML2 represents a portion of the outline of the fusion zone 98*x* which is located on the upper side of the centerline CL. An outer line AL1 is drawn externally of and along the outline ML1 with an allowance SL provided therebetween, and an inner line BL1 is drawn internally of and along the outline ML1 with the allowance SL provided therebetween. The outer line AL1 is turned over upward about the centerline CL, and the resultant outer line is referred to as an outer line AL2. The inner line BL1 is turned over upward about the centerline CL, and the resultant inner line is referred to as an inner line BL2. In the example shown in FIG. 16, the allowance SL is 0.2 mm.

At this time, when even a portion of the outline ML2 of the fusion zone 98*x* falls outside a region enclosed by the outer line AL2 and the inner line BL2, the fusion zone 98*x* is judged asymmetrical with respect to the centerline CL. When the entire outline ML2 of the fusion zone 98*x* falls within the region enclosed by the outer line AL2 and the inner line BL2, the fusion zone 98*x* is judged substantially symmetrical with respect to the centerline CL.

According to the above criterion, the fusion zone 98*x* exemplified in FIG. 16(A) is judged asymmetrical with respect to the centerline CL, since the outline ML2 of the fusion zone 98*x* has a portion which is located internally of the inner line BL2. By contrast, the fusion zone 98 exemplified in FIG. 16(B) is judged substantially symmetrical with respect to the centerline CL, since the entire outline ML2 of the fusion zone 98 falls within the region enclosed by the outer line AL2 and the inner line BL2.

The examples shown in FIG. 16 use an allowance SL of 0.2 mm for judging whether or not the fusion zone is substantially symmetrical with respect to the centerline CL. However, the allowance SL can be set as appropriate according to the size and shape of the electrode tip. For example, the allowance SL may be set to 20% of the length of a long side of the electrode tip.

The examples shown in FIG. 16 use the outline ML1 located on the lower side of the centerline CL as a reference line. However, the outline ML2 located on the upper side of the centerline CL may be used as a reference line for judging whether or not the fusion zone is substantially symmetrical with respect to the centerline CL. Also, the reference line may be determined on the basis of an ideal shape of the fusion zone. The ideal shape is obtained when the fusion zone is formed with a sufficiently high temperature. In the example shown in FIG. 16(A), the outline ML1 located on the lower side of the centerline CL meets the condition of the ideal shape more closely than does the outline ML2 located on the upper side of the centerline CL. An ideal reference line may be obtained by simulation or the like.

DESCRIPTION OF REFERENCE NUMERALS

3: ceramic resistor
4: seal body
5: gasket
6: ring member
8: sheet packing
9: talc
10: ceramic insulator
11: front end portion
12: axial hole
13: leg portion
15: stepped portion
17: front trunk portion
18: rear trunk portion
19: flange portion
20: center electrode
21: electrode base metal
22: front end portion
25: core
30: ground electrode
31: distal end surface
32: proximal end portion
33: distal end portion
40: metal terminal
50: metallic shell
51: tool engagement portion
52: mounting threaded portion
53: crimp portion
54: seal portion
55: seat surface
56: stepped portion
57: front end portion
58: buckle portion
59: screw neck
90: center electrode tip
91: side surface
92: front end surface
95: ground electrode tip
95*b:* ground electrode tip
95*c:* ground electrode tip
95*d:* ground electrode tip
95*e:* ground electrode tip
95*f:* ground electrode tip
95*g:* ground electrode tip
95*h:* ground electrode tip
96: discharge surface
96*b:* discharge surface
96*c:* discharge surface
96*d:* discharge surface
96*e:* discharge surface
96*f:* discharge surface
96*g:* discharge surface
96*h:* discharge surface
98: fusion zone
98*b:* fusion zone
98*c:* fusion zone
98*d:* fusion zone
98*e:* fusion zone
98*f:* fusion zone
98*g:* fusion zone
98*h:* fusion zone
98*x:* fusion zone
99*g:* fusion zone
99*h:* fusion zone
100: spark plug
100*b:* spark plug
100*c:* spark plug
100*d:* spark plug
100*e:* spark plug
100*f:* spark plug
100*g:* spark plug
100*h:* spark plug
200: engine head
201: hole
205: peripheral-portion-around-opening Having described the invention, the following is claimed:

1. A method of manufacturing a spark plug which comprises:

an insulator having an axial hole extending therethrough in an axial direction;

a center electrode provided at a front end portion of the axial hole;

a substantially tubular metallic shell which holds the insulator;

a ground electrode whose one end portion is attached to a front end portion of the metallic shell and whose other end portion faces a front end portion of the center electrode; and a noble metal tip provided on a surface of the ground electrode which faces the front end portion of the center electrode, and having a discharge surface which forms a spark discharge gap in cooperation with the center electrode;

the method comprising:

a fusion-zone formation step of forming a fusion zone through radiation of a high-energy beam to a boundary between the ground electrode and the noble metal tip, said fusion-zone formation step including continuously radiating the high-energy beam to said boundary from a substantially vertical direction while moving the high-energy beam relative to the boundary, or vice versa, in a width direction of the ground electrode, wherein the width direction is maintained within a plane substantially parallel to a plane containing the boundary, wherein the fusion-zone formation step forms the fusion zone such that when the fusion zone is projected in a direction perpendicular to the discharge surface, 80% or more of an area of an overlap between the ground electrode and the noble metal tip overlaps the projected fusion zone and such that a shape of the fusion zone as viewed from a direction perpendicular to the discharge surface is substantially symmetrical with respect to a centerline perpendicular to a width direction of the ground electrode and passing through a center of the noble metal tip.

2. A method of manufacturing a spark plug according to claim 1, wherein the fusion-zone formation step includes:

radiating the high-energy beam to the boundary while reciprocally moving the high-energy beam relative to the boundary, or vice versa, and radiating the high-energy beam twice or more to a portion of the boundary, thereby rendering the shape of the fusion zone substantially symmetrical with respect to the centerline.

3. A method of manufacturing a spark plug according to claim 1, wherein the fusion-zone formation step includes:

radiating the high-energy beam to the boundary while moving the high-energy beam relative to the boundary, or vice versa, and varying output of the high-energy beam with the relative movement, thereby rendering the shape of the fusion zone substantially symmetrical with respect to the centerline.

4. A method of manufacturing a spark plug according to claim 3, wherein the fusion-zone formation step includes:

radiating the high-energy beam to the boundary while moving the high-energy beam relative to the boundary, or vice versa, such that the output of the high-energy beam is held constant after start of the relative movement and is then gradually reduced, thereby rendering the shape of the fusion zone substantially symmetrical with respect to the centerline.

5. A method of manufacturing a spark plug according to claim 3, wherein the fusion-zone formation step includes:

radiating the high-energy beam to the boundary while moving the high-energy beam relative to the boundary, or vice versa, such that the output of the high-energy beam is increased until the high-energy beam is near the centerline, and is then gradually reduced, thereby rendering the shape of the fusion zone substantially symmetrical with respect to the centerline.

6. A method of manufacturing a spark plug according to claim 1, wherein the fusion-zone formation step is such that radiation of the high-energy beam is initiated before the high-energy beam is radiated to the boundary.

7. A method of manufacturing a spark plug according to claim 1, wherein the fusion-zone formation step includes:

radiating the high-energy beam to the boundary from a direction parallel to a plane which contains the boundary.

8. A method of manufacturing a spark plug according to claim 1, wherein the fusion-zone formation step includes:

radiating the high-energy beam to the boundary from a direction oblique to a plane which contains the boundary.

9. A method of manufacturing a spark plug according to claim 1, wherein the high-energy beam is a fiber laser beam or an electron beam.

* * * * *